United States Patent [19]

Switall

[11] Patent Number: 4,571,092

[45] Date of Patent: Feb. 18, 1986

[54] LIQUID MIXING SYSTEM

[75] Inventor: Thomas G. Switall, Wheeling, Ill.

[73] Assignee: Ryco Graphic Manufacturing, Inc., Wheeling, Ill.

[21] Appl. No.: 647,893

[22] Filed: Sep. 6, 1984

[51] Int. Cl.[4] ..... B01F 7/22; B01F 15/02

[52] U.S. Cl. ..... 366/348; 137/93; 137/391; 366/142; 366/153; 366/349

[58] Field of Search ..... 366/131, 132, 134, 142, 366/151, 152, 153, 160, 162, 348, 349; 137/5, 93, 391

[56] References Cited

U.S. PATENT DOCUMENTS

| | | | |
|---|---|---|---|
| 3,591,147 | 7/1971 | Anderson | 366/142 |
| 3,608,869 | 9/1971 | Woodle | 366/132 |
| 3,885,587 | 5/1975 | Troope | 366/131 |
| 4,474,476 | 10/1984 | Thomsen | 366/152 |

*Primary Examiner*—Robert W. Jenkins

*Attorney, Agent, or Firm*—Lee, Smith & Zickert

[57] ABSTRACT

A liquid mixing system is disclosed which provides a continuous and constant pressure flow rate during operation, having particular use in spray dampening operations for offset printing procedures. The mixing system includes a stacked arrangement of a batch mixer and feed tank fluidly communicating therebetween, and transfer means sequentially activated to transfer the liquids to the feed tank upon completion of mixing the liquids. The feed tank having means for discharging liquids therefrom at a constant flow and pressure. Control means sequentially operate the system for the admission and mixing of liquids in predetermined amounts to the batch mixer, for transferring the mixed liquids from the mixer to the feed tank, and for discharging the mixed liquids from the feed tank. The system is capable of repetitive mixing and transfer cycles while continuously discharging from the feed tank at a constant flow rate.

10 Claims, 4 Drawing Figures

AIR SUPPLY
WATER

ELECTRIC POWER
10
16
52
54
56
58
22
50
14
74
24
26
60
88
30
20
62
48
44a
76
46
28
40
38
L2
32
90
12
34
L1
36
18
42
ETCH
38
66
64
70
78
44b
68
L4
86
L3
72
82
80
84
TO SPRAY DAMPENING SYSTEM

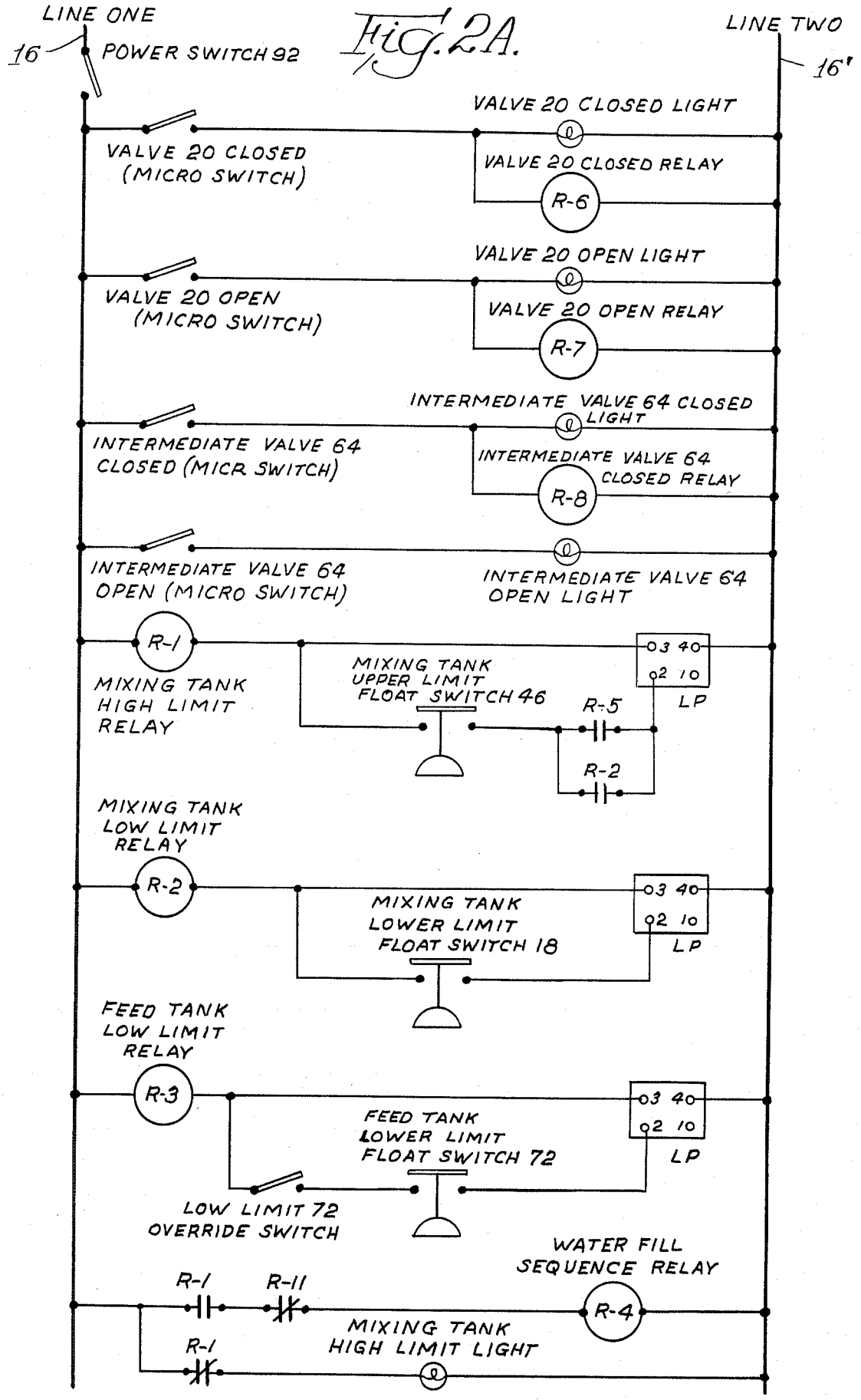
Fig. 2A.
LINE ONE
16
POWER SWITCH 92
LINE TWO
16'
VALVE 20 CLOSED LIGHT
VALVE 20 CLOSED (MICRO SWITCH)
VALVE 20 CLOSED RELAY
R-6
VALVE 20 OPEN LIGHT
VALVE 20 OPEN (MICRO SWITCH)
VALVE 20 OPEN RELAY
R-7
INTERMEDIATE VALVE 64 CLOSED LIGHT
INTERMEDIATE VALVE 64 CLOSED (MICR SWITCH)
INTERMEDIATE VALVE 64 CLOSED RELAY
R-8
INTERMEDIATE VALVE 64 OPEN (MICRO SWITCH)
INTERMEDIATE VALVE 64 OPEN LIGHT
R-1
MIXING TANK HIGH LIMIT RELAY
MIXING TANK UPPER LIMIT FLOAT SWITCH 46
R-5
R-2
LP
MIXING TANK LOW LIMIT RELAY
R-2
MIXING TANK LOWER LIMIT FLOAT SWITCH 18
LP
FEED TANK LOW LIMIT RELAY
R-3
FEED TANK LOWER LIMIT FLOAT SWITCH 72
LP
LOW LIMIT 72 OVERRIDE SWITCH
WATER FILL SEQUENCE RELAY
R-1
R-11
R-4
MIXING TANK HIGH LIMIT LIGHT
R-1

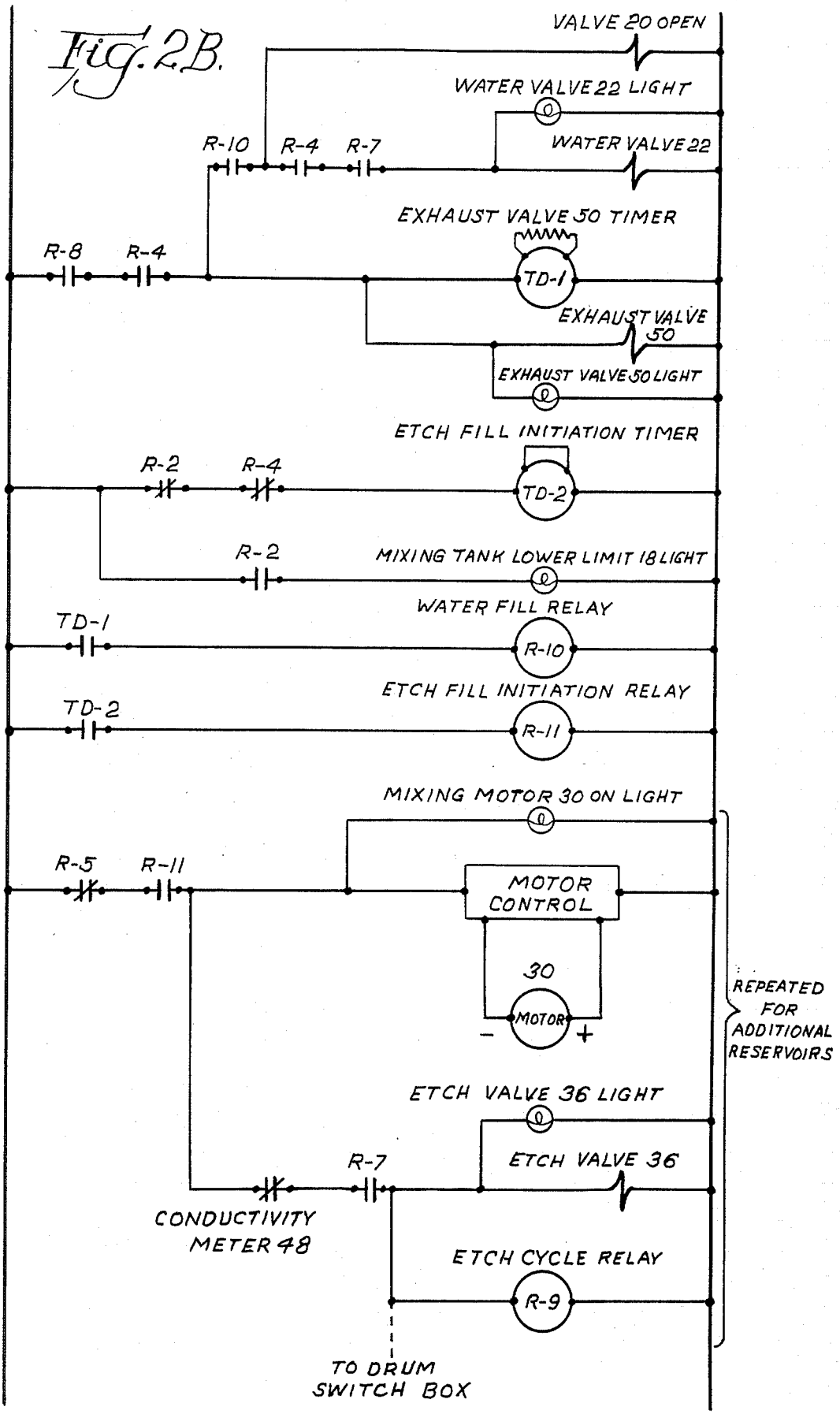
Fig. 2B.
VALVE 20 OPEN
WATER VALVE 22 LIGHT
R-10
R-4
R-7
WATER VALVE 22
EXHAUST VALVE 50 TIMER
R-8
R-4
TD-1
EXHAUST VALVE 50
EXHAUST VALVE 50 LIGHT
ETCH FILL INITIATION TIMER
R-2
R-4
TD-2
R-2
MIXING TANK LOWER LIMIT 18 LIGHT
WATER FILL RELAY
TD-1
R-10
ETCH FILL INITIATION RELAY
TD-2
R-11
MIXING MOTOR 30 ON LIGHT
R-5
R-11
MOTOR CONTROL
30
MOTOR
−
+
REPEATED FOR ADDITIONAL RESERVOIRS
ETCH VALVE 36 LIGHT
R-7
ETCH VALVE 36
CONDUCTIVITY METER 48
ETCH CYCLE RELAY
R-9
TO DRUM SWITCH BOX

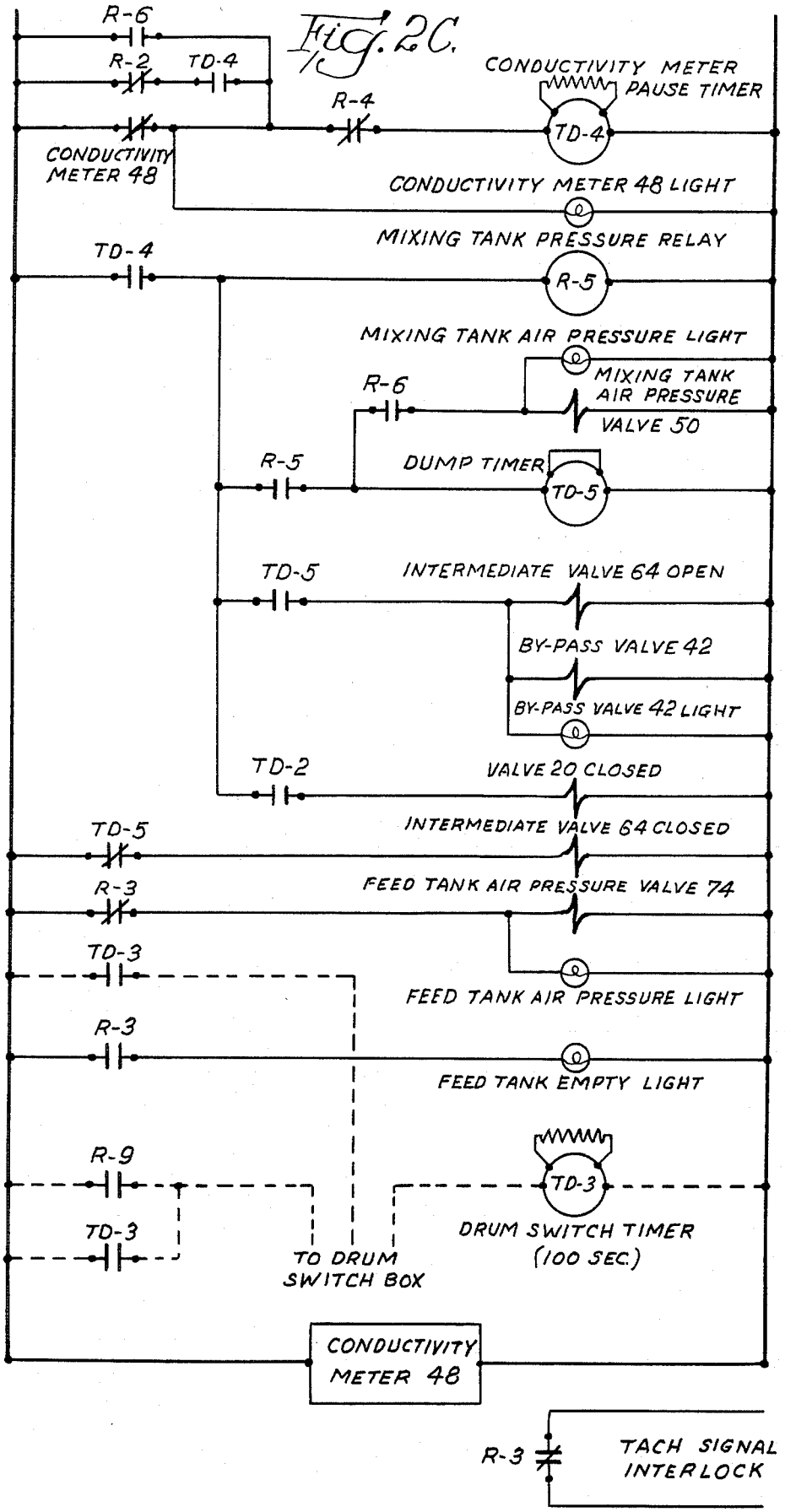
Fig. 2C.
R-6
R-2
TD-4
R-4
CONDUCTIVITY METER PAUSE TIMER
TD-4
CONDUCTIVITY METER 48
CONDUCTIVITY METER 48 LIGHT
MIXING TANK PRESSURE RELAY
TD-4
R-5
MIXING TANK AIR PRESSURE LIGHT
R-6
MIXING TANK AIR PRESSURE VALVE 50
R-5
DUMP TIMER
TD-5
TD-5
INTERMEDIATE VALVE 64 OPEN
BY-PASS VALVE 42
BY-PASS VALVE 42 LIGHT
TD-2
VALVE 20 CLOSED
TD-5
INTERMEDIATE VALVE 64 CLOSED
R-3
FEED TANK AIR PRESSURE VALVE 74
TD-3
FEED TANK AIR PRESSURE LIGHT
R-3
FEED TANK EMPTY LIGHT
R-9
TD-3
TD-3
DRUM SWITCH TIMER (100 SEC.)
TO DRUM SWITCH BOX
CONDUCTIVITY METER 48
R-3
TACH SIGNAL INTERLOCK

LIQUID MIXING SYSTEM

BACKGROUND OF THE INVENTION

This invention relates to an improved mixing system having particular use in preparing a spray dampening fluid of the type employed in offset printing. More particularly the mixing system accurately controls the amount of dampening fluid and water mixture and provides a continuous cycling system offering a constant pressurized flow of dampening fluid mixture. The mixing system is useful in providing the spray dampening fluid for the spraying system of copending application Ser. No. 518,470, filed July 29, 1983, entitled "Variable Frequency Spray Dampening System.".

In manufacturing systems which require continuous batch mixing and feeding of chemicals for a subsequent processing step, it is most often desirable to provide a mixing system which can offer a constant influent rate and which at the same time can continuously mix chemicals in desired proportions.

Complex proportional mixing systems using liquid motor drives and metering pumps, such as lost motion pumps, exist in the art but it would be highly desirable to attain an effective and reliable mixing system which is simplified and greatly reduces equipment supervision that otherwise results with the more complicated mixing systems.

A particular need in the offset printing business involves dampening the printing rolls with a water-etch mixture to enable them to be activated for reception of ink in a well-known manner. Therefore, the invention is directed for use in such spray dampening systems, but also has wide utility in other industrial processes requiring the continuous feed and constant flow of chemicals mixed in pre-selected proportions.

SUMMARY OF THE INVENTION

The present invention is a simplified but improved, liquid mixing system that provides automatic recycling which can constantly discharge the mixed chemicals at a constant flow rate on damand in tandem operation with a separate system or process, such as spray dampening equipment for offset printing rolls.

In summary of the invention, there is provided a liquid containment means in the form of a batch mixer preferably vertically stacked above a feed tank. The mixer and feed tank communicate therebetween, such as by means of an intermediate valve. A normally closed first valve communicates with the batch mixer and with feed lines from a first or parent liquid source and feed lines from at least one second or additive liquid source. At the initiation of a mixing operation, and during cyclical continuous operation, a low limit sensing means, disposed interiorly of the mixer, signals that fluid in the mixer is below a predetermined level. The low limit sensing means is part of a sequence control means and responsively signals the first valve to open for influence of the first liquid from a normally closed supply valve associated with the first liquid supply source and which is activated to open. Upon filling the batch mixer to a predetermined level, a high limit sensing means is activated and the sequence control means responsively signals the supply valve to close and thereby terminate the influence of the first liquid. A mixer motor having mixing blades interiorly of the batch mixer is then started. At the same time, the control means initiates the admittance of a second liquid by opening a supply valve associated with a second liquid supply source. The second liquid enters the batch mixer through the open first valve. Within the mixer there is an electrical conductivity sensing means which is also part of the control means. This sensing means senses when a pre-set conductivity is reached whereupon the second liquid supply valve is de-activated and closes. The mixer motor continues mixing for a pre-set duration and then is de-activated. The first valve is then closed. A three-way air valve, associated with an air pressure source communicating with the batch mixer, is signalled to open to introduce air from a pressurized feed line into the batch mixer and pressurize the mixer. When pressurized, intermediate valve means and an air pressure by-pass valve, both separately communicating between the batch mixer and stacked feed tank, are activated to open. The mixed first and second liquids are transferred under pressure into the feed tank.

The feed tank is also in communication with a source of pressurized air, which is controlled by another three-way air valve. This air valve opens responsively to a low limit sensor when fluid is above a predetermined level in the feed tank. At start-up, when the feed tank level may be below the sensing means, the feed tank is not pressurized. In this case, the by-pass valve serves to equilibrate the air pressure when opened in order that the feed tank is immediately pressurized and ready to supply the water-etch mix under pressure through a discharge pressure regulator at the bottom of the tank. During continuous operation, the feed tank is pressurized when the intermediate valve opens, and displaced air flows up through the by-pass valve from the feed tank into the batch mixer as the fluid is transferred.

The low limit sensing means in the feed tank responds to the entering liquid and at a pre-set level signal the sequence control means to pressurize the feed tank by means of opening the three way air valve associated with the air pressure source. The air pressure source communicates with the feed tank by a feed line which is separate from the feed line serving the batch mixer. The discharge pressure regulator opens upon reaching a pre-set pressurization level and liquid in the feed tank is discharged into a supply line which conveys the liquid to a spray dampening system.

As mixed liquids in the batch mixer are transferred to the feed tank, the level drops to the low limit sensing means which then signals the sequence control means, and the intermediate valve means is closed. Then, the sequence control means activates the mixer air valve to switch to an exhaust position and de-pressurize the mixer. In sequence the first valve and supply valve for the first liquid are again opened for a next cycle. Continuous outlet discharge from the feed tank is maintained while the next mixing cycle in the batch mixer takes place, since the feed tank remains pressurized when fluid level therein remains above the low limit sensor.

In an alternative embodiment, pumps may be substituted for air pressurization. One pump, in replacement of the intermediate valve means, would communicate with the batch mixer for transfer of the mixed fluids to the feed tank. A second pump, in replacement of the feed tank pressure regulator, would discharge the mixed liquids into the supply line of the spray dampening system at a constant flow rate and pressure.

BRIEF DESCRIPTION OF THE DRAWINGS

One embodiment of the invention is illustrated in the following drawings in which:

FIGS. 2A–C is an electrical schematic of the circuitry for the sequence control means operating the liquid mixing system of FIG. 1.

DETAILED DESCRIPTION OF THE PREFERRED EMBODIMENT

Figure 1:
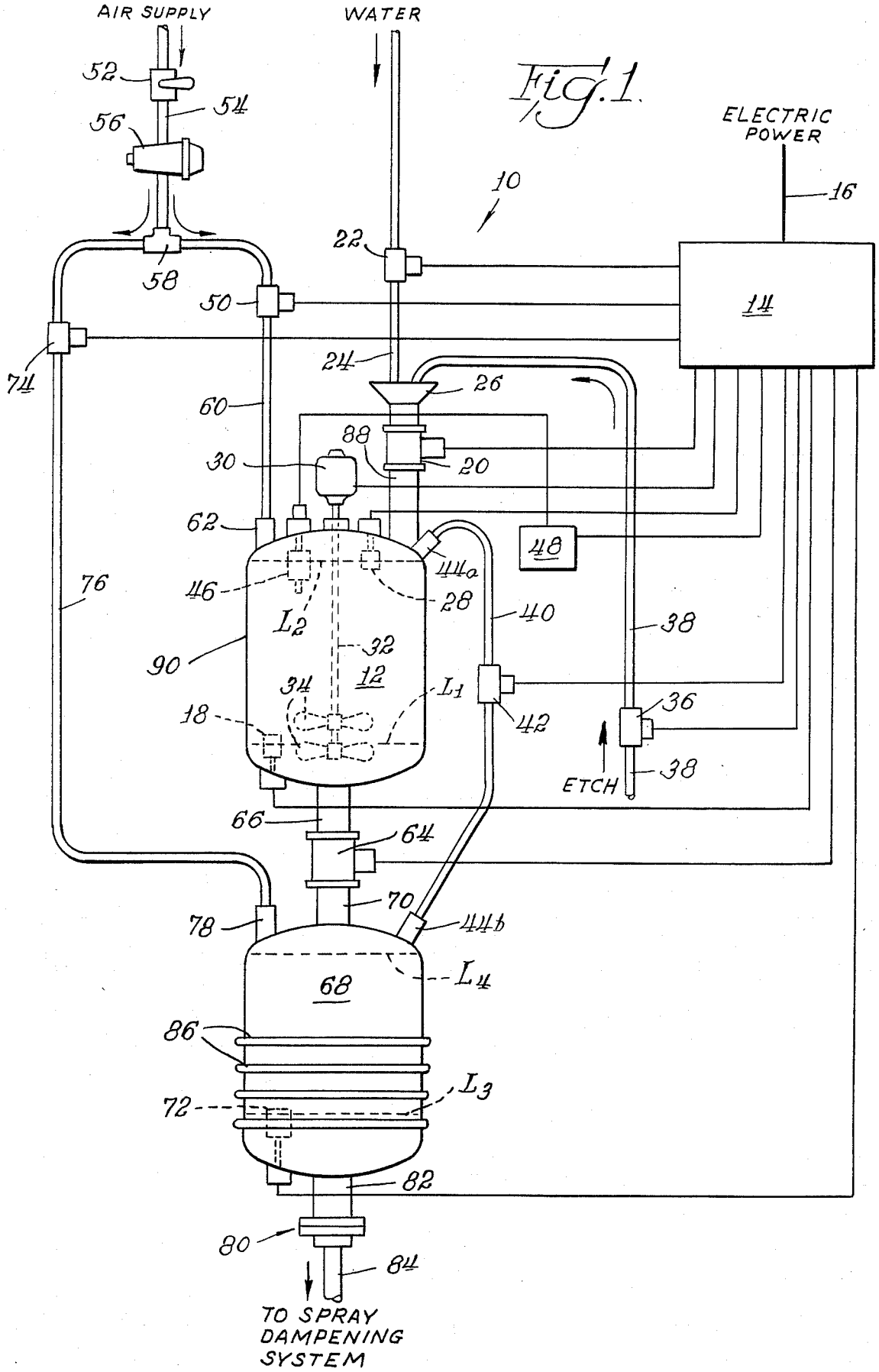
FIG. 1 is a schematic representation of the liquid mixing system.

In FIG. 1 there is shown liquid mixing system 10 which facilitates the mixing and continuous discharge of spray dampening fluids for use in an offset printing process. The invention will be appreciated as having application to numerous other types of industrial processes requiring mixing and supplying a continuous flow of liquids.

System 10 is characterized by the stacking of a batch mixer 12 over a feed tank 68 which are in fluid communication by means of an intermediate valve 64. Sequence control means 14 electrically controls operation of the system upon closing a power switch along power line 16, which is initiated by the printing process (not shown). Control means 14 comprises electrical sequence circuitry and connecting wiring as will be explained hereinafter with regard to FIGS. 2A–C.

Etch, ie., a wetting solution concentrate, is fed into mixing vessel 90 of batch mixer 12 via a pressurized feed line 38 to be mixed with water entering through feed line 24. Means for effecting transfer of the mixed liquids from the batch mixer to the feed tank, and for discharge from the feed tank, includes a source of pressurized air entering through air supply line 54. A normally closed valve 20, which fluidly communicates with water feed line 24 and etch feed line 38, controls water-etch admittance to mixing vessel 90. Normally closed water valve 22 operates in response to liquid level sensors, or limit probes, associating interiorly of mixing vessel 90, which regulate the volume of water per cycle. Etch supply valve 36 operates responsively to a signal generated by a conductivity probe 46 and associated meter 48 to supply etch to vessel 90.

After mixing cycles, a three-way air valve 50, along air line 54, is opened to pressurize mixing vessel 90. Intermediate valve 64 is then opened and the liquid is forcefully evacuated into feed tank 68. A by-pass valve 42 is simulataneously opened to equilibrate pressures between vessel 90 and feed tank 68. If feed tank 68 is already pressurized, displaced air will move upwardly to vessel 90 through by-pass line 40 as fluid enters tank 68. Pressurization of vessel 90 terminates when the liquid level drops below low level $L_1$ at sensing means 18.

Discharge of the mixed chemicals from feed tank 68 is initially made possible by the equalized pressurization created upon opening by-pass valve 42. Pressurization is thereafter continuously maintained by a three-way air valve 74 opening response to a signal generated by low limit sensing means 72 when liquid levels are above $L_3$ in the feed tank $L_3$. Pressurized air from line 76 is thereby introduced to the feed tank. Pressure regulator 80 opens at a minimum pre-set pressure level and serves to discharge the water-etch mix at constant pressure and flow into supply line 84. When the transfer from the batch mixer 12 has reduced the liquid level in mixing vessel 90 below sensing means 18, the sensing means signals the sequence control means and air by-pass valve 42 and intermediate valve 64 are closed. The mixing sequence repeats while the liquid in pressurized feed tank 68 is continuously discharged through regulator 80 into supply line 84 for use in a spray dampening system. Before liquid in feed tank 68 drops below level $L_3$, the mixing cycle is completed and the next batch is transferred from batch mixer 12. Thereby, continuous feed, at constant pressure, is achieved.

Operation Of The System

At the beginning of operation, vessel 90 and feed tank 68 are empty and not pressurized. The sequence of operation for the system is controlled by sequence control means 14, as will be explained. Initially a demand for the mixed fluids is signaled, such as from an offset printing procedure, by closure of a power switch on power supply line 16. The sequence of operation then begins.

Upon activation, sequence control means 14 receives a vessel-empty signal from low level sensing means 18, which at or below level $L_1$ has closed contacts. Normally closed valve 20 is activated to open and is followed by the activation of normally closed water valve 22. Water conveyed by feed line 24 is introduced through a flared receiving pipe 26 communicating with normally closed valve 20 and enters vessel 90 of batch mixer 12 via inlet pipe 88. Normally closed water valve 22 remains open until high limit probe 28 contacts open by the water filling to level $L_2$. At level $L_2$, sequence control means 14 closes water valve 22 and starts mixer motor 30. Mixer motor 30 communicates internally of batch mixer 12 by means of a shaft 32 having mixing blades 34 inside vessel 90. When the mixer motor starts, the probe 46 senses solution conductivity below a value pre-set at meter 48. Responsively, etch supply valve 36 is opened to allow etch to flow from feed line 38 into vessel 90 through opened valve 20. Feed line 38 communicates with a constant supply of etch, such as may be provided by a remote automatic pumping unit and etch reservoirs, whereby line 38 is pressurized and ready to supply valve 36. Conductivity probe 46, which communicates with the interior of mixing vessel 90, senses the increasing conductivity of the solution. Upon reaching the desired conductivity set at conductivity meter 48, the etch valve 36 open sequence ends. As the mixer motor continues to stir the solution, conductivity may drop below the desired level. In that case, the drop is sensed by probe 46, and etch supply valve 36 is signalled to open and supply additional etch to the mixer until the proper value stabilizes.

When the mixed solution reaches the stabile level of conductivity for about five to six seconds, valve 36 and valve 20 are both closed, and mixer motor 30 is de-energized. Mixing vessel 90 is then fully charged with the mixed liquid. Three-way air valve 50 along air supply line 54 is activated to open. An on-off valve 52 is manually operable and is preferably opened before beginning operation of the system in order to pressurize air supply line 54. A pressure regulator 56, disposed along line 54, maintains a pre-set constant pressure for introduction to the system. The regulated pressure in air supply line 54 is preferably maintained in the range of about 80–100 pounds per square inch. A T-pipe coupler 58 is provided to permit flow in two directions. At this stage of the operation, the pressurized flow is directed only through three-way air valve 50 into air line 60. An air line coupler 62 communicates to the interior of mixing vessel 90 and connects with air line 60 for admission of pressurized air into vessel 90 upon opening valve 50.

After a timed sequence of pressurization, intermediate valve 64, which is closed during mixing, is signaled to open and the mixed liquids transfer under pressure from batch mixer 12 via outlet pipe 66, through valve 64, into feed tank 68 via inlet pipe 70. If the liquid level in feed tank 68 is below level $L_3$, such as when system 10 is first started, it will not be pressurized when intermediate valve 64 is opened. Therefore, an air by-pass line 40 is provided and connects vessel 90 to feed tank 68 at air couplers 44*a*, 44*b*, respectively. A normally closed by-pass valve 42, disposed along line 40, is opened as intermediate valve 64 opens. The pressure between vessel 90 and feed tank 68 is thereby equalized and system 10 is immediately ready to supply a pressurized flow of dampening solution through feed tank regulator 80 into supply line 84.

Feed tank 68 includes low limit sensing means 72, which contacts open when the transferring fluids reach level $L_3$. Sequence control means 14 then activates three-way air valve 74 to open. Pressurized air from supply line 54 then also follows the second direction through T-pipe coupler 58, and passes through three-way air valve 74 into air line 76. Air line 76 communicates internally of feed tank 68 by means of air line coupler 78. Feed tank 68 is pressurized by air line 76 until fluid levels drop below $L_3$ at the termination of operation. Pressure regulator 80 communicates with the bottom of feed tank 68 at outlet pipe 82. Regulator 80 is of a conventional design and is set to open when pressures in the feed tank reach a pre-determined amount, generally at or slightly below the pressure in line 54. This value is reached initially when by-pass valve 42 opens and is maintained during operation by pressurization from feed line 76. The mixed water and etch are discharged under constant regulated pressure into supply line 84 and then to the spray dampening system. Feed tank 68 may also have conventional cooling coils 86 spaced therearound, as shown.

The continuous discharge from feed tank 68 is achieved by means of low level sensing means 18 inside vessel 90. When the transfer from batch mixer 12 causes the liquid level to drop below level $L_1$, sensing means 18 contacts close. At this point sequence control means 14 responsively closes intermediate valve 64, while at the same time feed tank 68 remains pressurized and continues discharging the previous batch into supply line 84. At the closure of intermediate valve 64, three-way air valve 50 is simultaneously activated and reverses to an exhaust position for a pre-set duration to de-pressurize of mixing vessel 90. The "empty" signal from low level sensing means 18 is the start of the next mixing cycle. After the timed sequence, air valve 50 returns to the closed position, valve 20 is again signaled to move to the open position, normally closed water valve 22 is again signalled to open, and the mix and transfer cycle repeats as explained above.

The illustrative embodiment shown in FIG. 1 uses pressurization as the means for transferring and discharging the mixed liquids. Alternatively, the use of pumps is envisioned. An electric pump, for example, could be provided between outlet pipe 66 and feed tank inlet pipe 70. The air supply means and pressurization steps would be eliminated. Intermediate valve 64 would then be eliminated and instead the pump would be signalled to start pumping when mixing ended. An electric pump for feed tank 68 could also be provided to associate with outlet pipe 82. Pressure regulator 80 would also be eliminated, and the constant pressure flow into supply line 84 would be maintained by the pump. In this alternate embodiment the steps of activating three-way air valves 50 and 74 and by-pass valve 42, would be replaced by activation of the electric pumps at the necessary times during the transfer and discharge sequences, as explained hereinbefore.

The Sequence Control Means

System 10 is sequentially operated by control means 14 having the circuitry as shown in FIGS. 2A–C, which comprises a single circuit, as will be understood. During operation, the activation, or energizing, of the various components of system 10 is indicated by control panel lights, so that the operator may monitor the system. The circled symbols referenced R-1, R-2, etc. are relays and TD-1, TD-2, etc., are time delay relays. The uncircled references R-1, R-2, TD-1, TD-2, etc., represent the respective normally closed or normally open contacts of the various R and TD relays. Notations on the Figure are provided to aid in following the sequence of operation of the mechanical components of system 10.

Initiating Operation

The circuitry is provided with power line 16 and ground 16'. A power switch 92 for power line 16 is closed when dampening solution is required. The power switch may be automatically closed in response to control circuitry of a spray dampening apparatus, as would be understood by one skilled in the art. When power switch 92 contacts close, the intermediate valve 64 closed solenoid is energized assuring that the intermediate valve 64 is closed at the beginning of operation. When starting operation, with mixing vessel 90 and feed tank 68 empty, relays R-1, R-2, and R-3 will all be energized by the closed upper and lower float switches 46, 18, respectively, in the upper tank, and closed low limit float switch 72 in the feed tank. The low limit 72 override switch is closed.

Relay R-4 will be energized as a result of relay R-1 contacts being closed, and relay R-8 will be energized through the intermediate valve 64 closed microswitch. Time delay relay TD-1 begins a six to eight second time delay "on" as a result of R-4 and R-8 contact closure, which also energizes the exhaust valve 50 solenoid and corresponding exhaust light.

The mixer means 12 is now prepared to begin a fill sequence. The feed tank 68 low limit light is on as a result of R-3 contact closure. The intermediate valve 64 closed light is on inasmuch as it is parallel to R-8 in the circuit. The mixer means 12 low limit light is on as a result of R-2 contact closure. At this point, valve 20 may be opened or closed, since either way, the circuit is unaffected. All other relays, timers, lights, and valves are off.

At the completion of the 6 to 8 second timing period of time delay TD-1, the fill sequence initiates.

The Fill Sequence

Step 1. Time delay relay TD-1 is energized when its timing period is complete.

Step 2. As a result of TD-1 contact closure, relay R-10 is energized.

Step 3. The valve 20 open solenoid is energized as a result of R-10 contact closure.

Step 4. Relay R-7 is energized by the valve 20 open microswitch contact closure.

Step 5. Water valve 22 solenoid is energized, and the water light is turned on as a result of R-7 contact closure. The mixing vessel 90 now begins to fill with water flowing through line 24.

Step 6. As the water level in vessel 90 rises above lower probe 18 at level $L_1$, relay R-2 is de-energized and the low limit light is turned off.

Step 7. When the water level in vessel 90 reaches high limit probe 46 at level $L_2$, relay R-1 is de-energized. As a result, the high limit light is turned on through a normally closed set of R-1 contacts. Meanwhile, R-4 is de-energized as R-1 contacts open.

Step 8. The valve 20 solenoid, water light, valve 22 solenoid, exhaust valve 50, time delay TD-1, and exhaust light are all de-energized as R-4 contacts open. Time delay relay TD-2 begins a 1.2 second time delay "on". Vessel 90 is now filled with the appropriate amount of water and is ready for mixing with the etch.

The Mixing Sequence

Step 9. At the completion of the 1.2 second timing period of TD-2, time delay relay TD-2 is energized.

Step 10. As a result of TD-2 contact closure, relay R-11 is energized.

Step 11. As a result of R-11 contact closure, mixer motor 30 is activated and begins to stir the fluid in vessel 90. The mixing light simultaneously is turned on. Also simultaneously, the etch light, etch valve 36, and relay R-9 are energized through closed conductivity meter 48 and R-7 contacts. Conductivity meter 48 relay is energized when conductivity, sensed at probe 46, is below a pre-set value. It de-energizes when the conductivity of the solution in vessel 90 exceeds this pre-set level.

Step 12. Since supply line 38 is associated with a pressurized source of etch, or an on-demand automatic pumping system, when valve 36 opens, etch flows into the vessel 90 through valve 20 and is blended with the water by the action of the blades 34 of the motor. The conductivity of the solution is increased.

Step 13. When the conductivity of the solution exceeds the pre-set value, the conductivity meter 48 relay de-energizes. Subsequently, the etch light, etch valve 36 and relay R-9 are de-energized as the meter relay 48 contacts open.

Step 14. Normally closed meter 48 relay contacts turn on the conductivity light and start the timing cycle of time delay relay TD-4. The motor 30 is still stirring the solution to ensure thorough mixing, and should conductivity drop below the pre-set value, etch valve 36 will be re-energized to add more etch and stabilize the mixed solution at the pre-determined level. When the mixed solution reaches a stable level of conductivity for about five to six seconds, TD-4 will complete its timing cycle and be energized. Transfer of the mixed water/etch solution is now ready to be made to feed tank 68.

The Transfer Sequence

Step 15. As a result of TD-4 contact closure, relay R-5 is energized. Valve 20 closed solenoid is also energized. Time delay TD-2 contacts are already closed.

Step 16. When R-5 energizes, normally closed contacts open to turn motor 30 and motor light off. Another set of R-5 contacts close to start the timing cycle of time delay relay TD-5.

Step 17. Relay R-6 energizes when the valve 20 closed microswitch closes and the valve 20 closed light turns on.

Step 18. The batch mixer air pressure valve 50 and air pressure light are energized. The mixing vessel 90 is then pressurized by air entering through feedline 60.

Step 19. Upon completion of the TD-5 timing cycle, about 1.2 seconds, TD-5 is energized.

Step 20. As the result of TD-5 contact, intermediate valve 64 open solenoid, by-pass valve 42 solenoid and by-pass valve light are energized. If feed tank 68 is empty, i.e., fluid level below level $L_3$ and float switch 72 contacts closed, it will not be pressurized due to relay R-3 normally closed contacts being open. In this case, the mixed solution will descend through intermediate valve 64 to fill the feed tank 68 and pressurized air will flow through by-pass valve 42 along line 40 to equalize the pressure between vessel 90 and feed tank 68. Thus, as intermediate valve 64 opens, mixing system 10 is ready to supply a pressurized mixed solution from feed tank 68 to a spray dampening system. If the feed tank 68 already has fluid above level $L_3$, and the low limit override switch is closed, as is the case during continuous operation, tank 68 will already be pressurized when the by-pass valve 42 and intermediate valve 64 open. Where feed tank 68 is already pressurized, the mixed solution will transfer via intermediate valve 64 and air displaced from feed tank 68 will flow up through valve 42 along line 40 into vessel 90.

Step 21. When the fluid level in vessel 90 drops to level $L_1$, relay R-2 is energized.

Step 22. As a result of R-2 contact closure, relay R-1 is energized. Another set of R-2 contacts open to de-energize time delay TD-2.

Step 23. Time delay TD-2 contacts then open to de-energize R-11.

Step 24. As a result of R-1 contact closure and R-11 normally closed contacts, R-4 is energized.

Step 25. Normally closed R-4 contacts open to de-energize time delay TD-4.

Step 25. TD-4 contacts open to de-energize TD-5, mixing tank 90 air pressure light, mixing tank air pressure valve 50, intermediate valve 64 open solenoid, by-pass valve 42 and the by-pass light.

Step 26. Normally closed TD-5 contacts energize the intermediate valve 64 closed solenoid.

Step 27. The intermediate valve 64 closed microswitch closes to energize the intermediate valve 64 closed light and R-8.

Step 28. As a result of R-4 and R-8 contact closure, time delay TD-1 begins its timing cycle.

Continuous Discharge

Following Step 28, the sequence is repeated beginning with Step 1. Inasmuch as the level in the feed tank 68 is above $L_3$ during continuous operation, feed tank lower limit switch 72 contacts will be open and the relay R-3 normally closed contacts will be closed to thereby open the feed tank air pressure valve 74, energize the associated air pressure light, and maintain pressurization of feed tank 68. Pressure regulator 80 is set to open and regulate outflow when pressure inside feed tank 68 reaches a pre-determined level, preferably set at or below the line 54 air pressure value. The mixed water-etch solution is discharged into line 84 for delivery to a spray dampening system continuously during repetitive sequences of system 10.

The Etch Supply

During mixing sequences, when etch valve 36 is energized, pressurized etch from a remote automatic pumping unit is fed to the mixing vessel 90. In the event that a remote pumping unit is not employed, a drum switch control may be provided with the mixer. The drum switching control would pump etch from one of a plurality of etch reservoirs and automatically switch to a full reservoir when a previous reservoir becomes empty. A signal to the drum switch control can be provided, as shown in FIGS. 2B, C, whenever the etch valve is energized. An etch demand relay may be provided in the drum switch control, which is energized whenever mixer 30 and etch value 36 are energized, on demand, to provide contact closure and send a signal to a pumping control circuit to activate a pump and siphon etch from a reservoir. Should a reservoir become empty, no etch will arrive through line 38 and the pre-set conductivity level at meter 48 will not be reached. Time delay relay TD-3 begins its timing cycle every time etch is demanded. When etch is supplied, the conductivity level is satisfied before the timing cycle is completed and the timing circuit is disabled in normal mixing operation. However, if the conductivity is not at the pre-set level after a pre-set period of about one hundred seconds, TD-3 is energized and contact closures provide a signal, as will be understood with respect to the schematic shown on FIG. 2C, to the drum switch control. The drum switch control may include means to determine and select a reservoir which is full, whereby an associated pump siphons etch to valve 36 along line 38 for admission to mixing vessel 90. The mixing sequence then continues. Upon satisfying the level of conductivity desired, and reaching stabilization for five to six seconds, time delay TD-4 will complete its timing cycle following the de-energizing of etch valve 36 and relay R-9, which are responsive to meter 48 contacts opening.

ACHIEVEMENTS OF THE INVENTION

A liquid mixing system is provided which maintains a continuous flow of a mixed water-etch solution at constant pressure for use in a spray dampening system. While the embodiment disclosed is directed toward use for spray dampening rollers in an offset printing process, it will be understood that invention has use in other industrial applications, wherein mixed fluids are required to be supplied at a constant rate of flow. The system maintains constant pressurization of a feed tank which continuously discharges to a supply line during repetitive mixing sequences in the batch mixer means stacked thereabove. The batch mixer alternately mixes and transfers mixed solution to the feed tank, until demand is satisfied. The liquid mixing system fill, mix, transfer, and discharge sequences are controlled by sequence control means electrically communicating with valves and mixer means in response to liquid levels in the system and to the conductivity of the water/etch solution. A wide range of sequence control means are envisioned.

What is claimed is:

1. A liquid mixing system for mixing and providing a discharge of liquid from the system under a constant pressure, said system comprising:

batch mixer means including a pressurizable mixing vessel and means for mixing liquids therein, said mixing vessel having a valved inlet for receiving liquids to be mixed and a valved outlet for transferring a batch of mixed liquids and mixing means within said vessel;

a pressurizable feed tank means in fluid communication with the valved outlet of said batch mixer means, whereby mixed liquids transferred from said batch mixer means into said feed tank means, said feed tank means having an outlet means capable of outletting a continuous discharge rate of mixed liquids;

means for pressurizing said mixing vessel and said feed tank means; and, control means for opening the valved inlet of said mixing vessel so that liquids may be introduced thereinto, for actuating said mixing means, for closing the valved inlet after said mixing vessel has been fully charged for pressurizing the vessel, for opening the valved outlet to transfer the mixed liquids from the mixing vessel to the feed tank means under pressure, and for closing the valved outlet while maintaining the feed tank means under substantially constant pressure during mixing and transfer operations; whereby mixed liquids may be constantly discharged under pressure through said feed tank outlet means.

2. A method for continuously mixing and discharging a first liquid and at least one other liquid utilizing a batch mixer means fluidly communicating with a feed tank means, said method comprising the steps of:

(a) detecting a low liquid level in said batch mixer means;

(b) opening a valved inlet communicating with said batch mixer means;

(c) supplying a first liquid through said valved inlet into said batch mixer means;

(d) filling said batch mixer means to a pre-determined higher level;

(e) detecting the pre-determined higher level;

(f) activating mixing means in the batch mixer means;

(g) supplying at least one other liquid through said valved inlet into said batch mixer means;

(h) closing said valved inlet when a pre-determined proportion of second liquid is supplied;

(i) de-activating said mixing means;

(j) transferring mixed liquids into said feed tank means by operation of transfer means;

(k) discharging said mixed liquids from said feed tank means by operation of discharge means;

(l) re-detecting a low liquid level in said batch mixer means;

(m) de-activating said transfer means;

wherein steps (b) through (j), (l) and (m) are a repetitive routine for mixing and transfer and wherein the discharging step (k) continues while steps (b) through (j), (l) and (m) repeat, whereby constant discharge of mixed liquids from the feed tank means is obtained.

3. A method in accordance with claim 2 wherein said transfer means comprises a pressurized air system and valve means communicating between said batch mixer means and feed tank means, whereby the step of transferring includes pressurizing the batch mixer means and opening the valve means thereby forcing the mixed liquids under pressure into said feed tank means and equalizing air pressure therebetween.

4. A method in accordance with claim 2 wherein said discharging means comprises a pressurized air system and pressure regulator means communicating with an outlet of the feed tank means, whereby the step of discharging comprises pressurizing said feed tank means and forcing the mixed liquids under pressure from the feed tank means through said outlet and pressure regulator means.

5. A method in accordance with claim 2 wherein said means for transferring and means for discharging comprise a pressurized air system wherein said steps of transferring and discharging comprise pressurizing the batch mixer means and feed tank means and forcing the mixed liquids under pressure from said batch mixer means into said feed tank means and then outwardly therefrom.

6. A method in accordance with claim 2 wherein said means for transferring and means for discharging comprise pumps, wherein said steps of transferring and discharging comprise pumping the mixed liquids from said batch mixer means and feed tank means, respectively.

7. A liquid mixing system for mixing at least two liquids and providing a constant pressurized discharge from the system, said system comprising:

batch mixer means including a pressurizable mixing vessel, means for mixing liquids therein, a valved inlet for receiving liquids to be mixed in said vessel, and a valved outlet for transferring a batch of mixed liquids from said vessel;

a pressurizable feed tank means in fluid communication with the valved outlet of said batch mixer means, whereby mixed liquids may be transferred from said batch mixer means into said feed tank means, said feed tank means having a discharge outlet for constant discharge of mixed liquids;

control means for opening the valved inlet of said batch mixer means so that liquids may be introduced thereinto, for opening the valved outlet after the liquids have been mixed, and for again closing the valved outlet after the mixed liquids have been transferred to said feed tank means;

and pressurizing means in fluid communication with said batch mixer means and said feed tank means and responsive to said control means for pressurizing said batch mixer means after the valved inlet has been closed and for pressurizing said feed tank means when liquid is contained therein, whereby said feed tank means will be pressurized whenever there is liquid contained therein including during transfer of a batch of mixed liquids from said batch mixer means.

8. The liquid mixing system as in claim 7 wherein said pressurizing means comprises a pressurized air supply and valve means responsive to said control means.

9. The liquid mixing system as in claim 7 and further including equalizing valve means responsive to said control means for equalizing the pressure in said batch mixer means and said fixed tank means, whereby the mixed liquids may be transferred from said batch mixer means to said feed tank means without affecting the pressure in the feed tank means.

10. In a liquid mixing system for mixing at least one additive liquid with a parent liquid and wherein the additive liquid when added will alter the electrical conductivity of the parent liquid, liquid containment means for containing said parent liquid and any additive liquid which has been added to the parent liquid; mixing means for mixing the liquid contained in said liquid containment means, electrical conductivity sensing means for sensing the electrical conductivity of the liquid within said containment means, parent liquid charging means for charging the parent liquid into said liquid containment means; liquid additive charging means responsive to said sensing means for charging at least one liquid additive into said liquid containment means in sufficient quantity to bring the electrical conductivity of the resulting liquid mixture to within a predetermined range, whereby the quantity of liquid additive in the liquid mixture may be accurately controled, and liquid mixture transfer means responsive to said electrical conductivity sensing means for transferring the liquid mixture from said liquid containment means only after the electrical conductivity of the liquid mixture in said containment means is within a predetermined range.

* * * * *